United States Patent [19]

Saito

[11] 4,407,649

[45] Oct. 4, 1983

[54] INJECTION MOLDING MACHINE

[75] Inventor: Hiroji Saito, Sagamihara, Japan

[73] Assignee: Toshiba Kikai Kabushiki Kaisha, Tokyo, Japan

[21] Appl. No.: 343,969

[22] Filed: Jan. 29, 1982

[30] Foreign Application Priority Data

Jan. 2, 1981 [JP] Japan ..... 56-15264

[51] Int. Cl.[3] ..... B29F 1/06

[52] U.S. Cl. ..... 425/145; 425/451.2; 425/590

[58] Field of Search ..... 425/145, 451.2, 590

[56] References Cited

U.S. PATENT DOCUMENTS 4,274,823 6/1981 Stanciu ..... 425/145

*Primary Examiner*—Thomas P. Pavelko

*Attorney, Agent, or Firm*—Koda and Androlia

[57] ABSTRACT

An injection molding machine comprises an injection piston-cylinder mechanism including therein an injection piston and a booster piston. The booster piston is provided with a longitudinal through hole through which a pressurized fluid is supplied from an external source into the piston-cylinder mechansim so as to act on the injection piston to fill the mold cavity with molten bath. When the inner pressure of the cylinder chamber between both pistons reaches a predetermined value or the injection piston reaches a predetermined position, a valve assembly which is connected to the cylinder chamber through a conduit is operated so as to drain the pressurized fluid in the cylinder chamber in a controlled manner thereby to advance the booster piston.

5 Claims, 5 Drawing Figures

INJECTION MOLDING MACHINE

BACKGROUND OF THE INVENTION

This invention relates to an injection molding machine such as die-casting machine or plastic molding machine, and more particularly, an injection piston-cylinder mechanism provided with means for controlling injection pressure of the injection molding machine.

Generally, with an injection molding machine such as die-casting machine or plastic molding machine, in a case where a single-acting injection piston-cylinder assembly is used as a device for injecting molten bath into a mold cavity, it is considerably difficult to use any conventional control means to adjust a time of raising a pressure in the cylinder of the injection piston-cylinder assembly at a time of the completion of the injection of the molten bath into the mold cavity due to the single-acting injection piston, i.e. to adjust the rising of the pressure acting on the molten bath, because it is considerably hard to incorporate into the injection molding machine control valves such as pressure control valve and flow control valve having quick response ability and sufficient precision.

Actually, pressure in the piston-cylinder mechanism rises quickly at an injection operation, so that high pressure affects on the surface layer of a die-cast product before the surface layer has been completely solidified thereby to break the solidifying surface of the product, which causes formation of burrs thereon.

There is also known an injecting molding machine which includes a booster piston-cylinder assembly in a case where an injection pressure in addition to that applied by a single-acting injection piston will be required to inject the molten bath into a mold cavity or where it is required to quickly raise the pressure for injecting the molten bath thereinto.

However, in such cases, a surge-pressure over a preset pressure is additionally caused and applied to the mold at a time of compression of the injection, so that the pressure applied to the injected molten bath is over thereby to unwillingly open the mold, which causes the formation of the burrs on the surface of the mold product.

SUMMARY OF THE INVENTION

An object of this invention is to provide an improved injection molding machine capable of controlling pressure rising in an injection piston-cylinder assembly in a time when molten bath has been completely injected into the mold cavity thereby to obtain a mold product having few burrs on its outer surface.

Another object of this invention is to provide an injection molding machine comprising control means which controls pressure rising in the injection piston-cylinder mechanism in accordance with the surface condition of a product to be molded.

According to this invention, there is provided an injection molding machine which comprises an injection piston-cylinder mechanism including therein an injection piston and a booster piston located at a rear portion of the injection piston and provided with a central longitudinal through hole, a first valve assembly connected to a pressurized fluid source and the injection piston-cylinder mechanism so that the pressurized fluid supplied in the mechanism passes through the through hole of the booster piston and acts on the injection piston to fill a mold cavity of a mold with molten bath, and a second valve assembly connected to the mechanism which operates to discharge pressurized fluid in a cylinder chamber defined between the injection and booster pistons into a tank when a fact that the molten bath in the mold cavity provides a predetermined condition is detected thereby to move the booster piston in a controlled manner.

DESCRIPTION OF THE PREFERRED EMBODIMENTS

Figure 1:
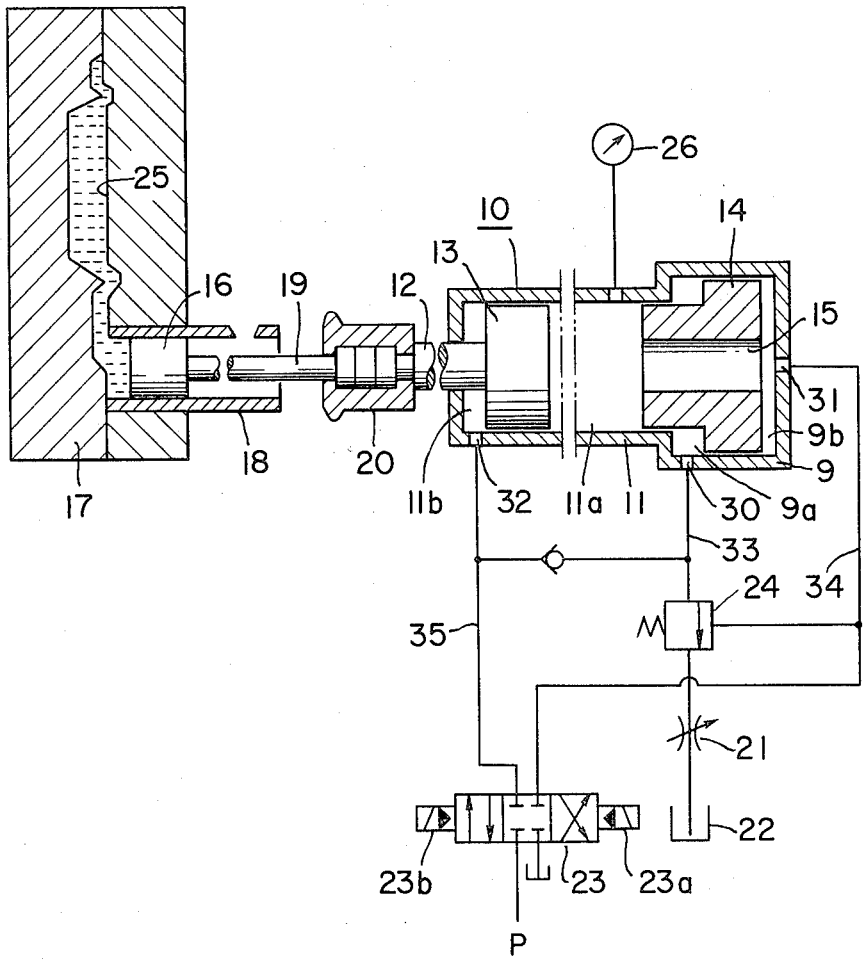
FIG. 1 is a diagrammatic representation partially in section showing one embodiment of an injection molding apparatus according to this invention.

FIG. 1 shows an injection piston-cylinder mechanism of an injection molding machine and a control circuit connected thereto for operating the same, in which an injection piston-cylinder mechanism 10 comprises a cylinder having two small and large cylindrical portions 11 and 9, an injection piston slidably inserted into the cylinder 11, and a booster piston 14 slidably inserted into the cylinder portion 9 and provided with a central longitudinal through hole 15. Reference numeral 16 designates a plunger slidably fitted into a sleeve 18 attached to a mold 17 so as to inject molten bath into the mold cavity 25 in accordance with the operation of the injection piston-cylinder assembly 10. The plunger 16 is operated by a plunger rod 19 which is connected thereto at one end and connected to a piston rod 12 of the piston 13 through a joint member 20 at the other end.

A cylinder port 30 is provided for the peripheral surface of the cylinder portion 9 and communicated with a tank 22 through a conduit 33 to which a sequence valve 24 and a flow control valve 21 are connected. A cylinder port 31 is also provided at the end portion of the cylinder 9 and the cylinder port 31 is connected to a flow direction change-over valve 23 through a conduit 34. The change-over valve 23 is also connected to a cylinder port 32 provided for the peripheral surface of the cylinder portion 11 through a conduit 35.

The flow control valve 21 operates so as to control flow amount of a pressurized fluid passing through the conduit 33 towards the tank 22 from the front cylinder chamber **9*a* defined within the cylinder 9 when the booster piston 14 moves leftwardly as viewed in FIG. 1 thereby to control the leftwardly moving speed of the booster piston 14. The sequence valve 24 is opened to let the pressurized fluid in the cylinder chamber 9*a* flow towards the tank 22 when the fluid pressure in the rear cylinder chamber 11*a* defined within the cylinder 11 reaches a predetermined value. Fluid pressure in the chamber 11*a* can be measured by a pressure indicator 26**.

In FIG. 1, is shown a state where the molten bath is injected into the mold cavity regardless of the positions of the valves 23 and 24.

The injection molding machine according to this invention operates as follows.

Figure 2:
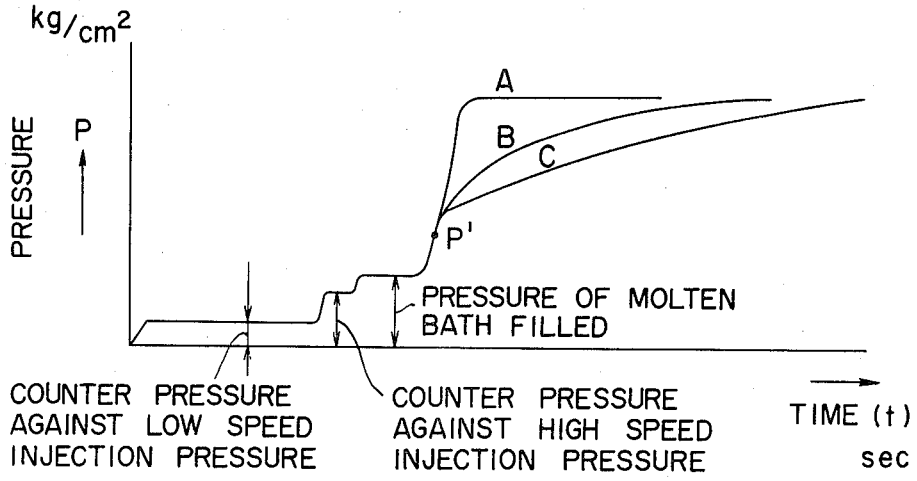
FIG. 2 is a graph showing a relationship between counter pressure against injection pressure and injection time when the apparatus shown in FIG. 1 is used.

After the molten bath, usually molten metal, has been poured into the injection sleeve 18, a solenoid valve 23*a* is energized so as to shift the change-over valve 23 leftwardly from the position shown in FIG. 1. The pressurized fluid is supplied into the piston-cylinder mechanism 10 from a pressurized fluid source P connected to the change-over valve 23 through the conduit 34, the cylinder port 31, and the longitudinal through hole 15 of the booster piston 15 thereby to push forwardly the injection piston 13 (leftwardly as viewed in FIG. 1) to fill the mold cavity of the mold 17 with the molten bath. In this state, the pressure in the front cylinder chamber 11*a* has gradually rised and when it reaches a predetermined value, the sequence valve 24 opens and the pressurized fluid in the cylinder chamber 9*a* is discharged into the tank 22 through the cylinder port 32, the sequence valve 24, and the flow control valve 21. Thus, the booster piston 14 advances leftwardly because of the pressure difference in the front and rear cylinder chambers 9*a* and 9*b* of the cylinder portion 9. When the booster piston 14 begins to be advanced, the inner pressure in the piston-cylinder mechanism 10 can be controlled by adjusting the flow control valve 21 as shown in FIG. 2, thus controlling the advancing speed of the booster piston 14. In such manner, the inner pressure can be adjusted or controlled as represented by lines B and C in FIG. 2 in accordance with the condition of the surface layer of the solidified molten bath injected into the mold cavity 25 thereby to obtain a mold product having few burrs.

FIG. 2 is a graph showing a relation between the counter pressure of the molten bath against injection pressure P and the time t, in which a point P' shows a fact that the booster piston 14 begins to be advanced.

After the injection operation has been completed, the change-over valve 23 is shifted rightwardly to drain the pressurized fluid in the front cylinder chamber 11*b* of the cylinder portion 11 into the tank 22 through the cylinder port 32 and the conduit 35.

Figure 3:
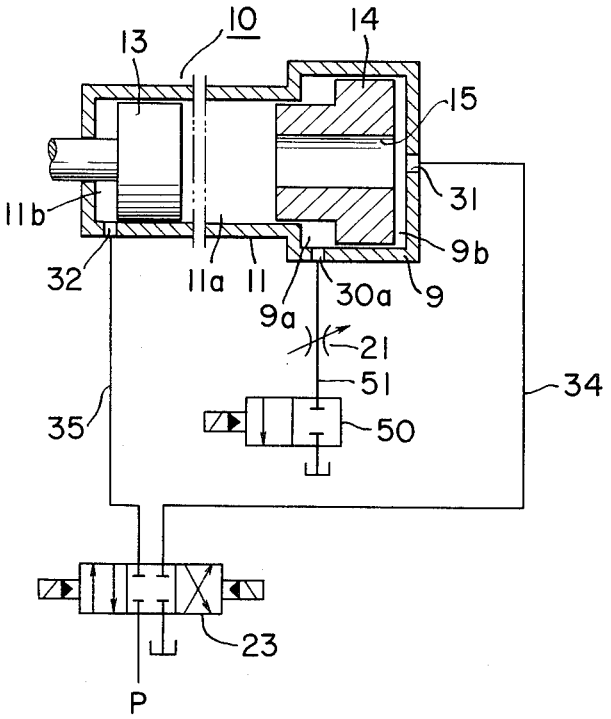
FIG. 3 shows a diagrammatic representation partially in section of another embodiment of this invention.

Although in FIG. 1 is shown an embodiment in which the booster piston 14 moves leftwardly at a time when a pressure in the cylinder chamber 11*a* reaches a predetermined valve, FIG. 3 shows another embodiment in which the booster piston 14 moves leftwardly when the injection piston 13 reaches a predetermined position and the injection piston 13 and the booster piston 14 are independently operated by respective change-over valves 23 and 50. Namely, in FIG. 3, the change-over valve 23 acts so as to supply the pressurized fluid into the piston-cylinder mechanism 10 through the conduit 34, the cylinder port 31, and the through hole 15 of the booster piston 14 thereby to move the injection piston 13 leftwardly by the same manner as that described in connection with the embodiment shown in FIG. 1. When the fact that the injection piston 13 reaches a predetermined position is detected by a device, not shown, such as a limit switch, the fact is transmitted to the change-over valve 50. The change-over valve 50 is then shifted rightwardly from a position shown in FIG. 3 and connected to the conduit 51 so as to drain the pressurized fluid in the cylinder chamber 9*a* through the cylinder port 30*a* and the flow control valve 21, and the booster piston 14 moves leftwardly at a speed controlled by the flow control valve 21. Thus, the injection piston 13 and the booster piston 14 can be independently operated by the different change-over valves 23 and 50.

Figure 4:
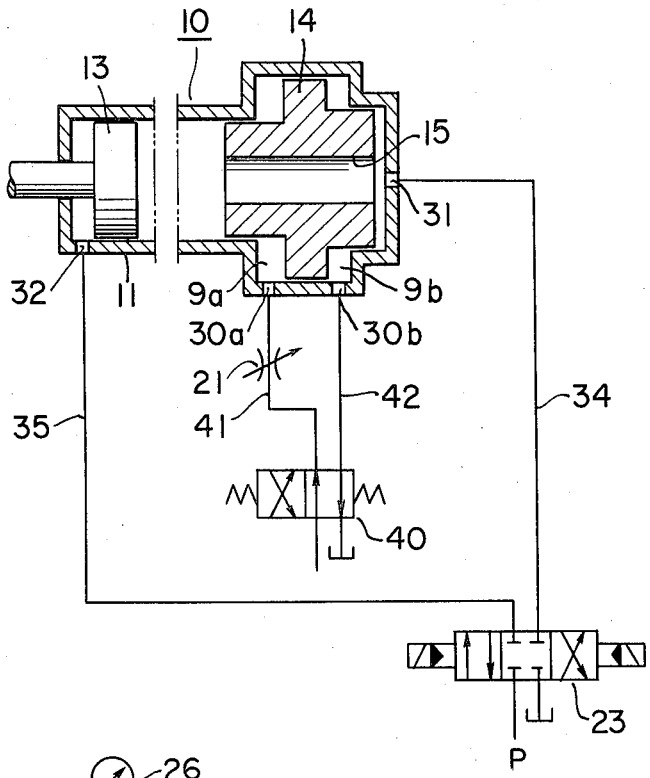
FIG. 4 shows a modified example of the apparatus shown in FIG. 3.

FIG. 4 shows a modification of the piston-cylinder mechanism of FIG. 3, in which the booster piston 14 comprises three portions having different diameters as shown in FIG. 3 and a change-over valve 40 for changing over the flow direction of the pressurized fluid is connected to the booster cylinder chambers 9*a* and 9*b* through cylinder ports 30*a* and 30*b* and conduits 41 and 42, respectively. The piston-cylinder mechanism 10 of FIG. 4 operates in substantially the same manner as described in connection with FIG. 3 and with this example, since the booster piston 14 comprises three portions having different diameters and the cylinder chambers 9*a* and 9*b* are connected to the direction change-over valve 40, the speed control of the booster piston can also be performed.

Figure 5:
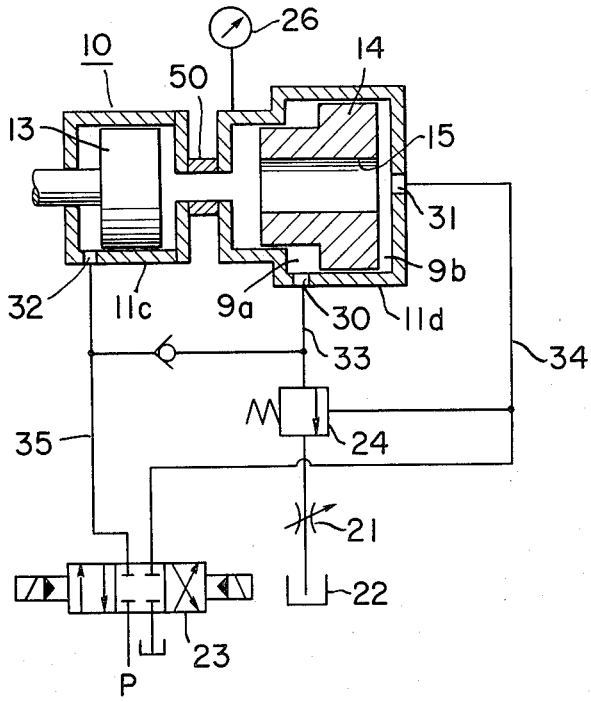
FIG. 5 shows a cross section of an injection piston-cylinder assembly of the other embodiment of the apparatus shown in FIG. 1.

Although, in the foregoing, is described an injection piston-cylinder mechanism in which the cylinders 11 and 9 of the injection piston-cylinder assembly and the booster piston-cylinder assembly are integrally constructed, in an embodiment shown in FIG. 5, a booster piston-cylinder assembly 9*c* and a booster piston-cylinder assembly 11*c* are independently constructed and interconnected through a pipe member 50. The mechanism 10 shown in FIG. 5 can also be operated in substantially the same manner as described in connection with FIG. 1.

It will be understood that although in FIG. 1 the injection piston 13 has the same diameter as that of the small cylindrical portion of the booster piston 14, these pistons can be constructed to have different diameters in accordance with operational requirements, for example, pressure increasing speed or shapes, thickness, or material of a product to be injected.

It will also be apparent to those skilled in the art that the foregoing descriptions refer to some preferred embodiments of this invention and that various modifications and changes may be made without departing from the true scope and spirit of the invention as defined in the appended claims.

What is claimed is:

1. An injection molding machine comprising an injection piston-cylinder mechanism including therein an injection piston and a booster piston located at a rear portion of said injection piston and provided with a central longitudinal through hole, first valve means connected to a pressurized fluid source and said injection piston-cylinder mechanism so that the pressurized fluids supplied into said injection piston-cylinder mechanism passes through said through hole of said booster piston and acts on said injection piston thereby to fill a mold cavity of a mold with molten bath, and a second valve means connected to said injection piston-cylinder mechanism which operates to discharge pressurized fluid in a cylinder chamber between said booster piston and said injection cylinder into a tank at a time when a fact that the molten bath injected into said molted cavity produces a predetermined condition is detected thereby to move said booster piston in a controlled manner.

2. The injection molding machine according to claim 1 wherein said first valve means is a direction change-over valve to change over the flow direction of the pressurized fluid and said second valve means comprises a sequence valve which operates so as to discharge the pressurized fluid in said cylinder chamber when an injection pressure reaches a predetermined value and a flow control valve connected in series with said changeover valve to a conduit connecting said cylinder chamber and said tank, whereby said booster piston advances in a controlled manner.

3. The injection molding machine according to claim 1 wherein said first valve means is a first direction change-over valve to change over the flow direction of the pressurized fluid and said second valve means comprises a second direction change-over valve which operates so as to discharge the pressurized fluid in said cylinder chamber when said injection piston reaches a predetermined position and a flow control valve connected in series with said second change-over valve to a conduit connecting said cylinder chamber and said tank, whereby said booster piston advances in a controlled manner.

4. The injection molding machine according to claim 3 wherein said booster piston comprises three cylindrical portions having different diameters and said second change-over valve is connected to a first cylinder chamber defined between said injection piston and said booster piston and a second cylinder chamber defined between the rear end portion of said booster piston and an end portion of a cylinder of said injection piston-cylinder mechanism.

5. The injection molding machine according to claim 1 wherein said injection piston-cylinder mechanism comprises an injection piston-cylinder assembly and a booster piston cylinder assembly which are interconnected through pipe means.

* * * * *

UNITED STATES PATENT AND TRADEMARK OFFICE

CERTIFICATE OF CORRECTION

PATENT NO. : 4,407,649

DATED : October 4, 1983

INVENTOR(S) : Hiroji Saito

It is certified that error appears in the above—identified patent and that said Letters Patent is hereby corrected as shown below:

At [30] Foreign Application Priority Data:

change "January 2, 1981," to --February 4, 1981--.

Signed and Sealed this

Twentieth Day of December 1983

[SEAL]

Attest:

GERALD J. MOSSINGHOFF

Attesting Officer

Commissioner of Patents and Trademarks